United States Patent [19]

Deucher

[11] 4,067,249

[45] Jan. 10, 1978

[54] RAISING CHAIR

[75] Inventor: Conrad R. Deucher, Uster, Switzerland

[73] Assignee: Caterpillar Tractor Co., Peoria, Ill.

[21] Appl. No.: 692,071

[22] Filed: June 2, 1976

[30] Foreign Application Priority Data

June 3, 1975 Switzerland ..... 7116/75

[51] Int. Cl.[2] ..... A61G 5/00

[52] U.S. Cl. ..... 297/330; 297/DIG. 10; 297/DIG. 4

[58] Field of Search ..... 297/DIG. 10, DIG. 4, 297/330, 436

[56] References Cited

U.S. PATENT DOCUMENTS

| | | | |
|---|---|---|---|
| 1,372,546 | 3/1921 | Read et al. | 297/436 X |
| 2,656,876 | 10/1953 | Larrick | 297/DIG. 4 |
| 3,216,738 | 11/1965 | Bockus | 297/DIG. 10 |
| 3,261,031 | 7/1966 | Gates | 297/DIG. 10 |
| 3,343,871 | 9/1967 | Yates | 297/DIG. 10 |
| 3,379,450 | 4/1968 | Jones | 297/330 X |
| 3,589,769 | 6/1971 | Bressler | 297/330 |
| 3,866,973 | 2/1975 | Heubeck | 297/330 |

*Primary Examiner*—Francis K. Zugel
*Attorney, Agent, or Firm*—John W. Grant

[57] ABSTRACT

To assist a person from seated to an erect position a mechanism for raising and straightening a seat surface and the seat backrest to a nearly vertical position is provided, which avoids substantial relative motion between the body of the person and the seat surface and the seat backrest. In the erected position of the chair, a groundplate of the footrest is firmly supported on the ground.

13 Claims, 2 Drawing Figures

RAISING CHAIR

BACKGROUND OF THE INVENTION

The invention relates to a raising chair, particularly a foldable raising wheelchair for disabled or sick persons of the type including a support frame, a seat surface, a foot rest, and/or a seat backrest, and a mechanism to raise ("erect") and lower the seat.

Different raising chairs are known which are capable to move a disabled person, e.g. a paraplegic patient, from a sitting position into an extended, near-vertical, erect, standing position. The advantages of such a raising chair for patients are generally recognized. Repeated raising and sitting contributes to blood circulation. Of medical importance is the possibility of daily standing exercises without the need of help or special equipment. This diminishes the susceptibility for decubitus and osteoporosis. Of practical importance is also the increased independence of the person and the improved possibility of professional integration provided by increased mobility. Of psychological importance is further that a raising chair gives the patient increased self confidene and the same eye-level with a standing person in conversation.

A prior-art raising chair is described in the U.S. Pat. No. 3,589,769. In this prior-art raising chair, the seat surface member and the seat backrest comprise a plurality of padded rollers. It must be noted that in prior-art raising chairs a relative motion occurs on a raising or lowering motion between the patient and the surfaces of the chair on which the body of the patient rests. To facilitate this "gliding" motion, the cited prior-art chair has a seat and a backrest in form of rollers. This facilitates the change of the patient from the seating position to the erected position, and vice versa. However, this design is found uncomfortable by the patient after prolonged sitting. Because the body is not evenly supported, stagnations of blood may occur which may be unhealthy or even dangerous for the patient.

It is an object of the present invention to avoid the disadvantages of prior-art raising chairs.

SUBJECT MATTER OF THE INVENTION

Pivot points between a seat and a footrest and/or a seat backrest are located in such a way, that on erecting or lowering of the seat practically no relative motion takes place between the body of the person and the seat and/or the seat backrest.

In this way the advantages of a raising chair are obtained which have rollers as supporting surfaces, but the disadvantages of such an arrangement of rollers are avoided.

Further, the chair of this invention can be designed as a foldable raising chair.

The present invention is based on the finding that on raising or lowering of the seat surface a motion between the seat surface and the body of a patient can be avoided, when the pivot points between the seat surface and the footrest and the seat backrest are properly arranged with regard to the knee and hip joints.

According to the invention the seat backrest is pivotally mounted at the back of the seat surface a distance above the seat surface. By placing the pivot point above the seat surface it becomes located close to the hip joint, so that, in contrast to the prior art chairs, gliding of the body at the seat back is effectively avoided.

The seat is pivotally attached to the support frame a distance laterally below the seat surface offset from the front edge of the seat surface. Accordingly, on a raising movement the body of the patient is moved somewhat forward and down which gives the user more mobility in two dimensions. Of particular advantage is the embodiment when the footrest has a ground rest and is so dimensioned, that the ground rest comes to rest on the ground when the chair is in an erecting position. By resting on the ground tipping of the chair in the erecting position is prevented. Accordingly, the chair may be built in lightweight design without any danger that it will tip in the erecting position. Nevertheless, pivotal mounting of the seat surface at a distance from the surface plane of the seat provides that in a sitting position the footrest will be lifted up a sufficient distance from the ground. It is advisable to provide the footrest with a foot support adjustable in height. This makes it possible to accommodate the different leg lengths of patients.

To keep the footrest in every position in the desired inclination, a connection bar is provided at the footrest a distance from the pivotal connection of the seat and is removably and pivotally attached to the support frame by a pivot. Because of removable attachment of the footrest to the support frame, the footrest may be easily removed when not required by the patient.

To erect or lower the seat, a mechanism is provided having at least one gear segment at the seat with which a pinion of an electric motor located on the support frame meshes. This mechanism is very simple. Preferably two limit switches being actuatable by an actuating member located on the gear segment to switch-off the electric motor on reaching the erecting position or the seat position.

BRIEF DESCRIPTION OF THE DRAWINGS

The foregoing and other objects, features, and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

Figure 1:
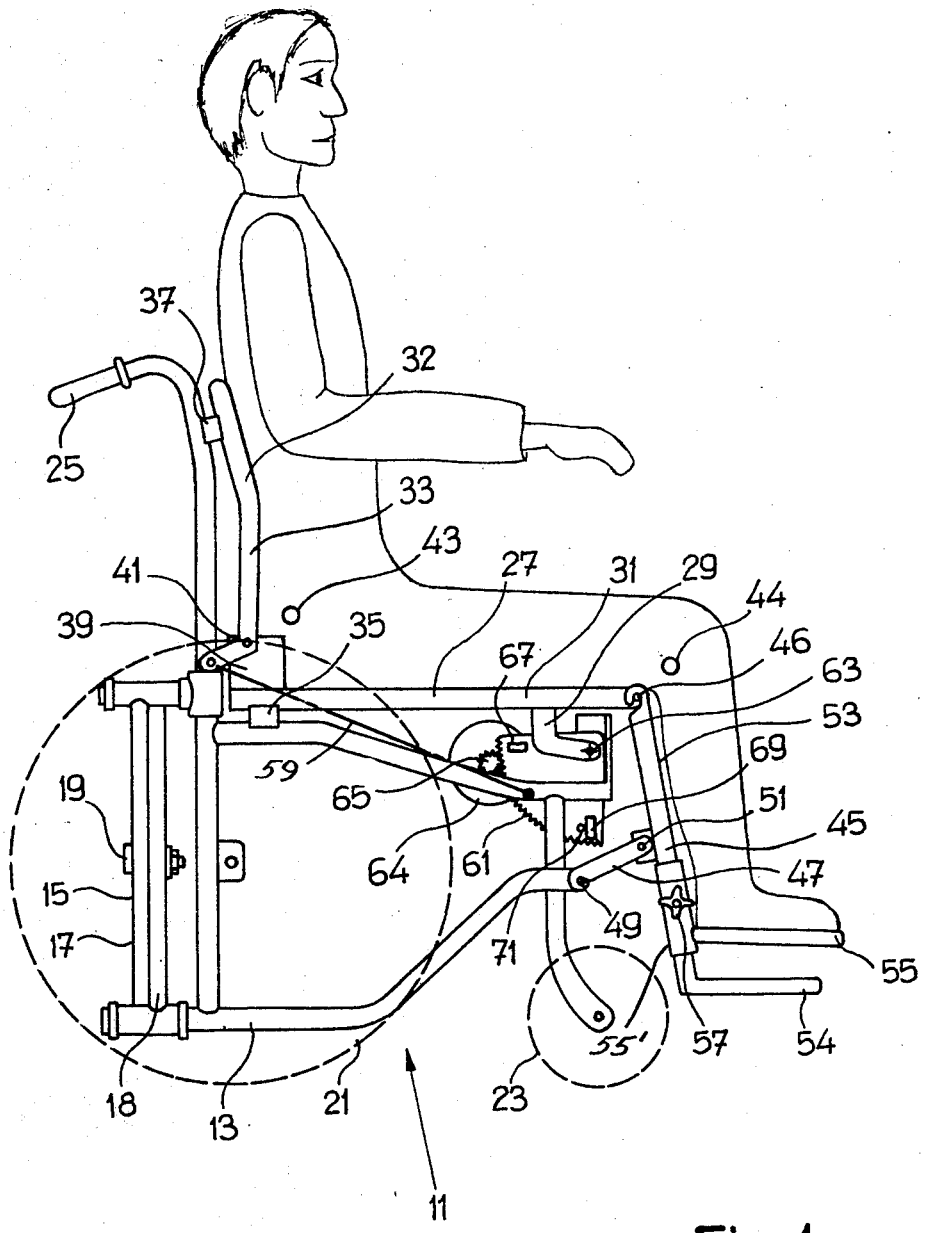
FIG. 1 is a fragmented side view showing a raising chair according to the invention in a sitting position.
Figure 2:
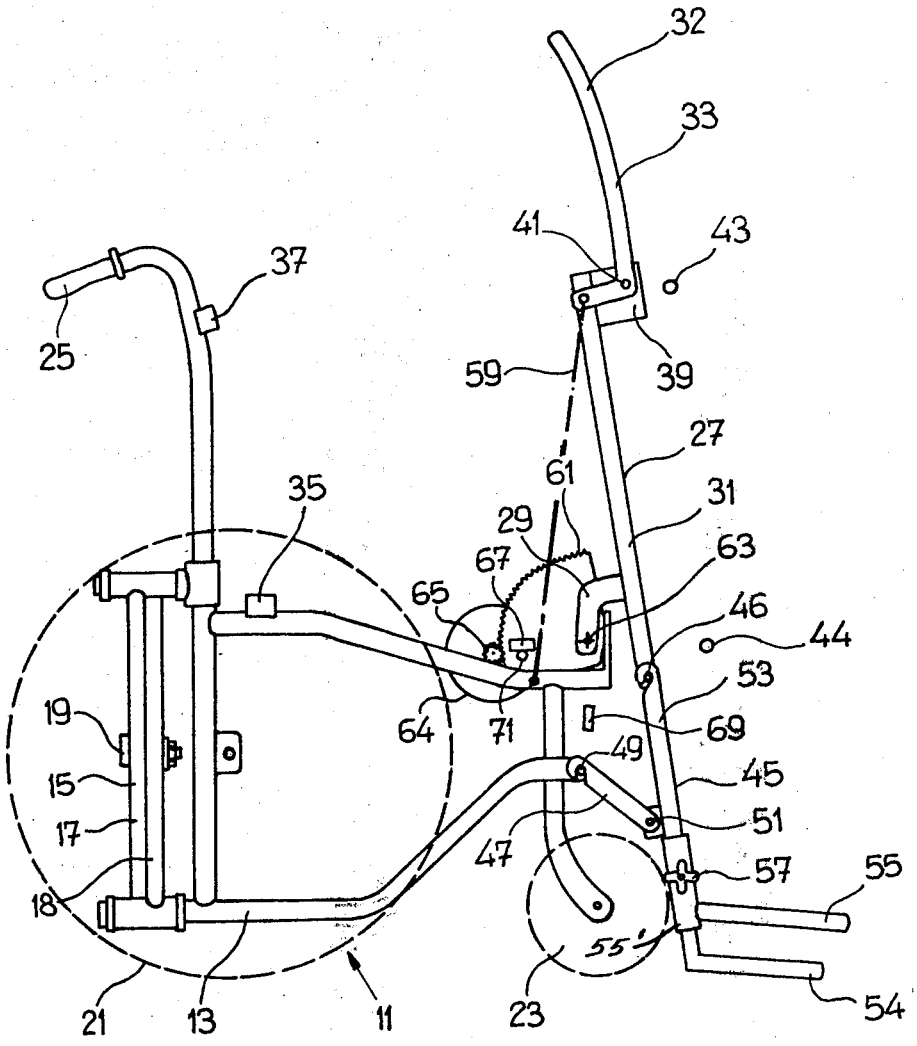
FIG. 2 is a view similar to FIG. 1 showing a raising chair in an erecting position.

The raising chair shown in FIGS. 1 and 2 comprises substantially a frame 11 which includes two side frames 13 connected by struts. Preferably struts are provided at the back and at the front of the frame. The back strut consists advantageously of two pieces of tubing 17, 18 connected in the middle by a pivot 19. The front strut, not shown in the drawing, consists preferably of a toggle lever. This permits folding of the raising chair, that is, to bring it into a position in which both side frames 13 lie adjacent to each other, which is of advantage for storing or transporting the raising chair.

As is schematically shown, wheels 21 and 23 are attached to the chair when it is used as a wheelchair. Handles 25 permit moving of the chair by attendants.

A seat surface structure 27 is secured to the frame 11 at a pivot 63 which is located a distance below the plane of the seat surface and inside the front edge of the seat. For this purpose on each side of the seat a bent support arm 29 extends downwardly and forwardly from the seat member 31. The seat, or seat structure, substantially consists of two tubular elements 31 held spaced from each other on the side frames 13, between which tubular elements a sheet of fabric (not shown) or a sheet of any other suitable material extends. In a similar fashion also a seat back or backrest 32 consists of two tubular elements 33, between which a sheet extends, which is not shown in the drawings. This sheet permits a simple folding of the raising chair and provides a flexible support for the body of a patient. In the sitting position, the seat surface member 27 and the backrest 32 rest on support blocks 35, 37 of plastic or the like to support the seat surface member 27 and the backrest 32 on frame 11 (FIG. 1).

At the back of the seat on both sides thereof lugs 39 are provided, secured to the respective tubular elements 31 of the seat surface structure 27. The seat back 32 is pivotally connected on these lugs 39 at a distance above the seat surface. It should be noted that the pivot point 41 is very close to the particular cavity of the femur of the pelvis of the patient. In the drawing the approximate location of the articular cavity is schematically shown with a circle designated with the reference number 43. Reference number 44 designates the knee joint.

The footrest 45 is pivotally and removably connected at 46 to the front edge of the seat. At the footrest 45 a connection bar 47 is provided. The connection bar is removably and pivotally connected to the support frame 11 and can also pivot on a pivot 51 at the foot rest. The arrangement of the different elements is such that in a sitting position and in an erecting position the footrest remains in the same attitude.

The footrest 45 essentially comprises a tubular member 53 at either side of the person's leg. A ground rest 54 is attached to each tubular member 53. A foot support 55 connected to guide sleeve 55', which is movably supported on the tubular member 53 and can be locked by means of a set screw 57 at the desired height.

In order to secure the backrest 32 in upright position, at least one link, or parallelogram bar 59 is provided, shown in chain dotted line in FIG. 2, which is pivotally connected with the backrest 32 and with the support frame 11. This is schematically indicated in FIG. 2 to simplify the drawing.

The mechanism for erecting and lowering the seat comprises at least one gear segment 61 having the same pivot point 63 as the seat 27 with which it is rigidly connected. An electrical motor 64 is provided, whose pinion 65 meshes into the teeth of the gear segment 61. Limit switches 67, 69 provide for switching-off the electric motor 64, when, on erecting or lowering, an actuating member 71 located on the gear segment actuates the respective limit switches 67 or 69.

In order to make the raising chair foldable it is advisable to provide on both sides of the support frame 11 an electric motor 64 driving a corresponding gear segment 61.

OPERATION:

When a person sitting in the raising chair desires to be erected, he operates a switch (not shown), which puts the electric motor 64 in motion. In the view shown in FIG. 1 the drive pinion 65 runs counter-clockwise and drives the gear segment 61 clockwise. The seat 27 is slowly rotated into the position shown in FIG. 2, whereupon, when the actuating member 71 touches on the limit switch 67 the electric motor is switched off. Because the backrest 32 is, as indicated in FIG. 2, connected by parallelogram bar 59 to the support frame, it will always remain in an upright position. The footrest 54 moves downward, and, in the erecting position of the chair, the footrest rests with its ground plate 54 on the floor, so that a tipping of the chair is prevented.

If the patient desires to return from the upright position into the sitting position, he again operates the switch (not shown), whereupon the electric motor rotates the gear segment 61 in an opposite sense, that is counter-clockwise, until the seat is in the position shown in FIG. 1 in which the actuating member 71 switches-off the electric motor 64.

The positions of the axes of the backrest pivot 41, the footrest pivot 46 and the seat member pivot 63 individually and collectively are located to avoid substantial relative motion between the body of the person and the seat surface between members 27 and the seat backrest 32. The position of the axis of the seat member pivot 63 additionally positions the groundplate of the footrest firmly on the ground when the seat 27 is raised.

The present invention is not limited to the embodiment shown. Modifications are possible. The drawing does not show the raising chair in the exact scale. Further, parts, e.g. the arm rest, which are not necessary for the understanding of the invention, have been omitted.

I claim:

1. A raising chair comprising a support frame (11);

a seat structure (27);

seat pivot means (63) pivotally connecting said support frame (11) and said seat structure (22) to pivot between a substantially horizontal attitude for supporting a patient in a seated position and a substantially vertical attitude upon raising the patient to a substantially erect position, said seat pivot means (63) being located below the seating plane of said seat surface structure (27) and in the vicinity of the front edge of said seating plane of said seat surface structure (27) and offset rearwardly from the front edge of said surface structure (27);

a foot rest (45);

foot rest pivot means (46) pivotally connecting said seat surface structure (27) and said foot rest (45);

a seat back rest (32);

back rest pivot means (41) connecting said seat surface structure (27) and said back rest (32), said back rest pivot means (41) being located above the seating plane of said seat surface structure (27) when the chair is in sitting position;

and a mechanism (61, 64, 63, 29) to rotate the seat surface structure (27) between substantially horizontal and vertical positions in which said seat is, respectively, in substantially horizontal and vertical attitude;

the pivot axes of said seat pivot means (63) and of the backrest pivot means (41) being spaced from the front and plane of the seat surface structure (27) to position the respective pivot means relative to the hip and knee joints (43, 44) of a patient supported by the seat surface structure of the raising chair when in sitting position to cause substantially no relative motion between the seat surface structure (27) and the back rest (32), and the patient when said mechanism to rotate said seat surface structure is actuated to raise the chair and patient to erected position.

2. A raising chair as in claim 1 wherein said footrest pivot means (46) is a severable pivot positioned adjacent the front edge portion of said seat surface structure (27).

3. A raising chair as in claim 2 comprising further a connection bar (47) which is pivotally attached to said footrest (45) spaced from said footrest pivot means (46) and removably and pivotally attached to said support frame (11).

4. A raising chair as in claim 3 wherein said footrest (45) includes a gound rest means (54) for impinging on the ground when said seat surface structure (27) is placed in a substantially vertical position.

5. A raising chair as in claim 4 wherein said footrest (45) includes a height adjustable foot support (55).

6. A raising chair as in claim 5 wherein footrest (45) includes a tubular member (53), and said height-adjustable foot support (55) includes a guide sleeve (55') which is movable on the tubular member (53) of the footrest and lockable thereon.

7. A raising chair as in claim 1 further comprising at least one parallelogram bar (59) connected to both the backrest (32) and to the support frame (11) to keep the backrest (32) in upright position in every attitude of said seat surface (27).

8. A raising chair as in claim 1 wherein the mechanism to rotate the seat surface structure comprises at least one gear segment (61) attached to the seat surface structure (27) and a pinion (65) driven by an electric motor (64) located on the support frame (11) meshing with the gear segment (61) to rotate said seat surface structure (27) about the pivot axis of the seat pivot means (63).

9. A raising chair as in claim 8 further including two limit switches (67, 69) secured to the support frame (11), and an actuating member (71) located on the gear segment (61) connected to switch off the electric motor (64) on reaching the ends of travel of said gear segment (61).

10. A raising chair as in claim 2 further comprising at least one parallelogram bar (59) connected to both the backrest (32) and to the support frame (11) to keep the backrest (32) in upright position in every attitude of said seat surface (27).

11. A raising chair as in claim 3 further comprising at least one parallelogram bar (59) connected to both the backrest (32) and to the support frame (11) to keep the backrest (32) in upright position in every attitude of said seat surface (27).

12. A raising chair as in claim 2 wherein the mechanism to rotate the seat surface structure comprises at least one gear segment (61) attached to the seat surface structure (27) and a pinion (65) driven by an electric motor (64) located on the support frame (11) meshing with the gear segment (61) to rotate said seat surface structure (27) about the pivot axis of the seat pivot means (63).

13. A raising chair as in claim 11 wherein the mechanism to rotate the seat surface structure comprises at least one gear segment (61) attached to the seat surface structure (27) and a pinion (65) driven by an electric motor (64) located on the support frame (11) meshing with the gear segment (61) to rotate said seat surface structure (27) about the pivot axis of the seat pivot means (63).

* * * * *

UNITED STATES PATENT AND TRADEMARK OFFICE

CERTIFICATE OF CORRECTION

PATENT NO. : 4,067,249

DATED : January 10, 1978

INVENTOR(S) : Conrad DEUCHER

It is certified that error appears in the above-identified patent and that said Letters Patent are hereby corrected as shown below:

On the title page delete line 73: "Assignee: Caterpillar Tractor Co., Peoria, Illinois"

Signed and Sealed this

Eighteenth Day of April 1978

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,067,249

DATED : January 10, 1978

INVENTOR(S) : Conrad DEUCHER

It is certified that error appears in the above-identified patent and that said Letters Patent are hereby corrected as shown below:

On the title page, line 73: "Assignee" delete and replace by: Valutec AG, CH 8610 Uster, Switzerland This certificate supersedes certificate issued April 18, 1978.

Signed and Sealed this

*Twenty-ninth* Day of *August 1978*

[SEAL]

*Attest:*

RUTH C. MASON
*Attesting Officer*

DONALD W. BANNER
*Commissioner of Patents and Trademarks*